US005309737A

United States Patent [19]

Fountoulakis

[11] Patent Number: 5,309,737

[45] Date of Patent: May 10, 1994

[54] TAMPER PROOF DEVICE FOR A PIERCED EARRING

[76] Inventor: Marcos Fountoulakis, 192 Wentworth Ave., Cranston, R.I. 02905

[21] Appl. No.: 99,448

[22] Filed: Jul. 30, 1993

[51] Int. Cl.[5] ..... A44C 7/00

[52] U.S. Cl. ..... 63/12; 24/706.3; 24/704.1; 24/705

[58] Field of Search ..... 63/12, 13, 2; 24/706.3, 24/704.1, 705

[56] References Cited

U.S. PATENT DOCUMENTS

| | | | |
|---|---|---|---|
| 216,954 | 7/1879 | Heckmann | 24/705 |
| 2,552,151 | 5/1951 | Cohen | 63/12 |
| 3,122,007 | 2/1964 | Horland | 24/705 |
| 4,517,816 | 5/1985 | Hess | 63/12 |
| 4,658,481 | 4/1987 | Seyler | 24/704.1 |
| 5,170,542 | 12/1992 | Greenberg | 63/12 |

FOREIGN PATENT DOCUMENTS

| | | | |
|---|---|---|---|
| 557571 | 2/1957 | Italy | 63/12 |

*Primary Examiner*—Flemming Saether
*Attorney, Agent, or Firm*—Salter, Michaelson & Benson

[57] ABSTRACT

A tamper proof device is assembled with a pierced earring and clutch wherein it is operative for indicating if the pierced earring and clutch are subsequently disassembled. The tamper proof device includes an outer ring portion, an inner disc portion having a tapered central aperture and a plurality of break-away gates which extend radially outwardly from the disc portion and merge with the ring portion. The clutch is received within the ring portion wherein it is held in position by a plurality of inwardly extending protuberances, and the earring post is received through the tapered aperture and into the clutch. The tapered aperture in the disc portion frictionally engages a groove in the earring post so that when the earring post and clutch are pulled apart, the disc portion breaks away from the ring portion.

10 Claims, 1 Drawing Sheet

TAMPER PROOF DEVICE FOR A PIERCED EARRING

BACKGROUND AND SUMMARY OF THE INVENTION

The instant invention relates to the jewelry art and more particularly to a tamper proof device which is operative for indicating that a pierced earring and its respective clutch have been previously used.

While display cards are an effective way for displaying pierced earrings, it has been found that customers often disassemble the earrings and their respective clutches in order to try the earrings on before purchase. It has also been found that customers often purchase pierced earrings, take them home and wear them once or twice, and then return them for a refund or exchange. Retail earring vendors have always attempted to deter customers from returning earrings that have been worn for the obvious reasons that the vendors lose money on such returned merchandise. In addition, the earring vendors are also extremely cautious of earrings that have been tried on or returned because many persons who wear earrings develop infections around the pierced holes in their ears, often causing blood and other bodily fluids to be received onto the post and clutch of the earring. It has thus become increasingly important to earring retailers to prevent persons from trying on earrings and to prevent the return of earrings after they have been worn. However, there have heretofore been no effective means for determining if an earring has been tried on or worn.

The instant invention provides a tamper proof device which, when assembled with a pierced earring and clutch, effectively indicates to a merchant selling the earring if the earring and clutch have subsequently been tampered with or disassembled. The tamper proof device of the subject invention comprises an outer ring portion, an inner disc portion having a tapered central aperture, and a plurality of break-away gates which extend radially outwardly from the disc portion and merge with the ring portion. The clutch is received within the ring portion wherein it is held in position by a plurality of inwardly extending protuberances, and the earring post is received through the tapered aperture and into the clutch in a conventional manner. The tapered aperture in the disc portion is engageable with a groove in the earring post so that the earring post and the clutch cannot be pulled apart without breaking the disc portion away from the ring portion.

Accordingly, it is an object of the instant invention to provide a tamper proof device which, when assembled with a pierced earring and clutch, will indicate if the pierced earring and clutch have been subsequently disassembled.

It is yet another object to provide a tamper proof device which will indicate if a pierced earring has been tampered with or disassembled.

It is still another object to provide a tamper proof device for pierced earring which is compact in size, easy to manufacture, inexpensive and easy to assemble with the pierced earring.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
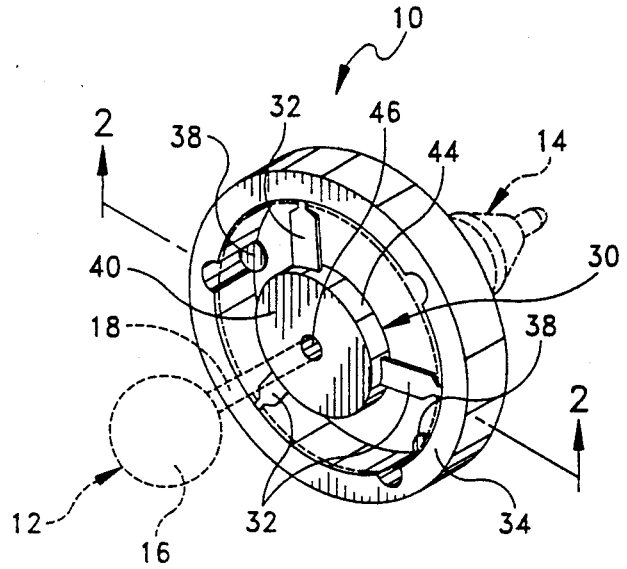
FIG. 1 is a perspective view of the tamper proof device of the instant invention with a pierced earring and a clutch assembled therewith.
Figure 2:
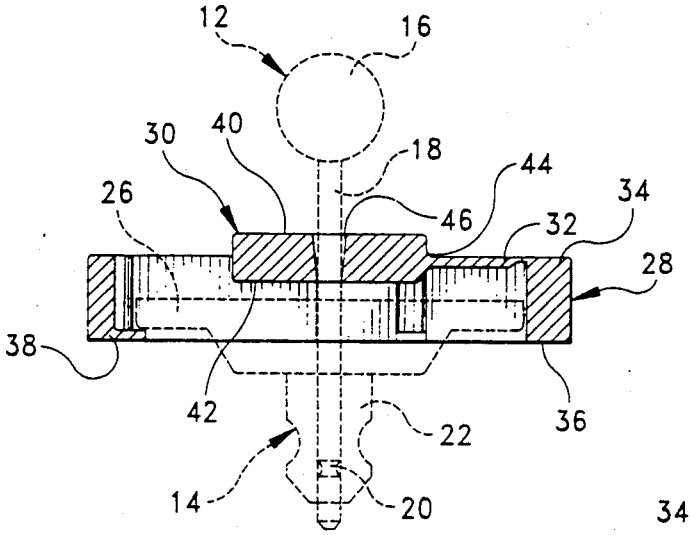
FIG. 2 is a cross-sectional view taken along line 2—2 of FIG. 1.
Figure 3:
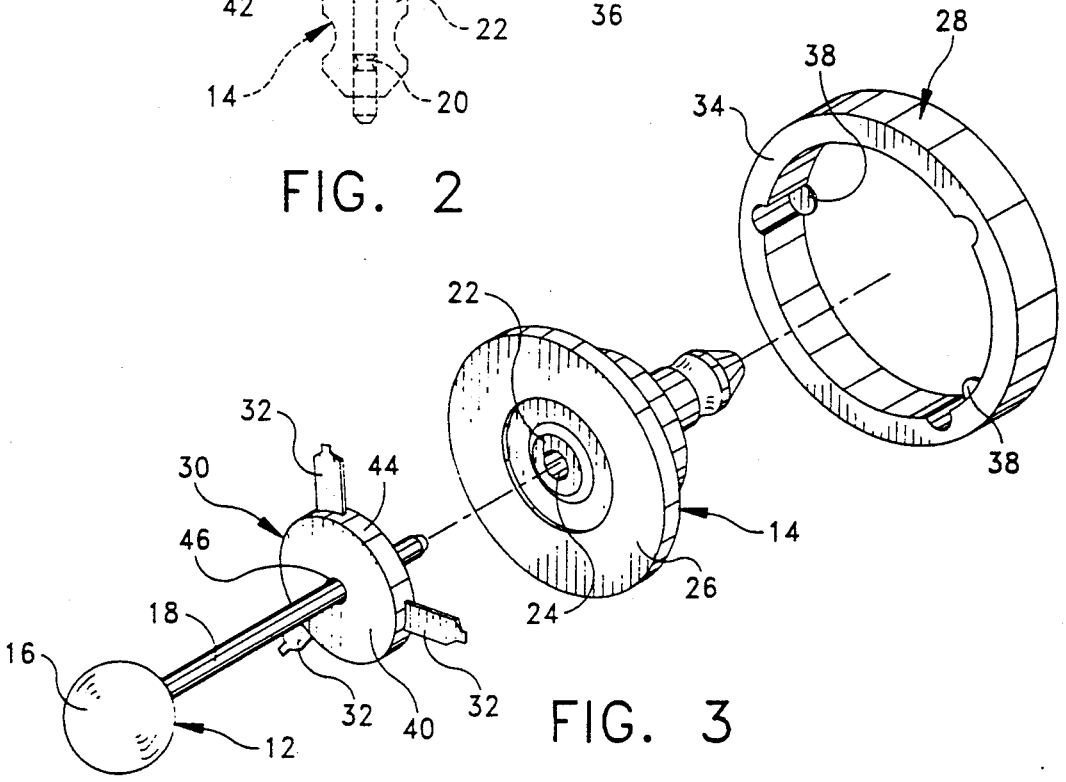
FIG. 3 is an exploded perspective view showing the earring and the clutch disassembled from the tamper proof device.

Referring now to the drawings, the earring tamper proof device of the instant invention is illustrated and generally indicated at 10 in FIGS. 1–3. As will hereinafter be more fully described, the tamper proof device, when assembled with a pierced earring generally indicated at 12, and a clutch generally indicated at 14, will indicate if the pierced earring 12 and the clutch 14 have been subsequently disassembled. The pierced earring 12 comprises an ornament portion 16 and a post portion 18 which extends rearwardly from the ornament portion 16. The post portion 18 includes a circumferential groove 20 (FIG. 2) adjacent the terminal end thereof. The clutch 14 is conventional in the art and it comprises a body portion 22 including a bore 24 therethrough, engaging means in the body portion (not shown) for engaging an earring post 18 received through the bore 24, and a backing disc 26 (FIG. 3). The security device 10 comprises an outer ring portion generally indicated at 28, an inner disc portion generally indicated at 30, and a plurality of break-way gates 32 which integrally join the disc portion 30 with the ring portion 28. The ring portion 28 of the device 10 includes upper and lower peripheral edges 34 and 36 respectively, and a plurality of protuberances 38 which extend radially inwardly from the lower peripheral edge 36. The disc portion 30 includes upper and lower surfaces 40 and 42 respectfully, an outer peripheral edge 44 and a central aperture 46. The central aperture 46 is tapered so that its diameter is larger at the upper surface 40 of the disc 30 and smaller at the lower surface 42 of the disc 30. The break-away gates 32 extend outwardly from the peripheral edge 44 of the disc portion 30 and integrally merge with the upper peripheral edge 34 of the ring portion 28 (See FIG. 2). The ring portion 28, the disc portion 30 and the break-away gates 32 are preferably integrally molded from plastic.

In use, the clutch 14 is received adjacent the lower peripheral edge 36 of the ring portion 28 so that the backing disc 26 rests on top of the radial protuberances 38, and the earring post 18 is slidably and frictionally received through the tapered aperture 46 in the disc portion 30 and into the bore 24 in the clutch 14 in a normal manner. (See FIG. 2). Once assembled with the tamper proof device 10, the earring 12 and clutch 14 cannot be disassembled without breaking apart the disc portion 30 and the ring portion 28 of the tamper proof device 10. In this regard, the groove 20 in the earring post 18 is operative for engaging with the tapered aperture 46 when withdrawn so that the earring post 18 cannot be pulled apart from the clutch 14 without breaking the break-away gates 32 and separating the disc portion 30 away from the ring portion 28.

While most conventional earring posts 18 include a circumferential groove 20 or indent for the purpose of preventing the earring post 18 and clutch 14 from being inadvertently disassembled, it is pointed out that there are a plurality of alternative methods of engaging the earring post 18 with the disc 30 and accordingly, the means for engaging the disc 30 and earring post 18 should not be specifically limited to the tapered aperture 46 and groove 20 arrangement as illustrated. Likewise there are a plurality of alternatives for engaging and holding the clutch 14 within the ring portion 28 of the device 10.

The tamper proof device 10 is easily incorporated for use with any type of earring display card (not shown), wherein the clutch 14 and security device 10 are received behind the display card and the earring post 18 is extended through the display card, through the aperture 46 in the disc portion 30 of the security device 10 and then into the clutch 14. When used with a display card, the tamper proof device 10 is hidden from view while being operative for indicating if the earrings 12 have been disassembled from the display card. It is understood also that the tamper proof device 10 can be utilized with other earring holding means.

It can therefore be seen that the instant invention provides a unique earring tamper proof device 10 which is operative for indicating if a pierced earring 12 and clutch 14 have been disassembled. The tamper proof device 10 provides a first portion 28 which is engageable with the clutch 14 of the earring, a second portion 30 which is engageable with the post portion 18 of the earring 12 and a plurality of break-away gates 32 which integrally join the clutch engagement portion 28 and the post engagement portion 30. In this manner, the earring post 18 cannot be disassembled from the clutch 14 without breaking the break-away gates 32 and separating the first and second portions of the device. Accordingly, once the earring 12 and clutch 14 are assembled with the tamper proof device 10, retail earring establishments can easily ascertain whether the earring 12 has been tried on or worn by simply viewing the status of the break-away gates 32 to determine if they have been broken or not. Intact gates 32 indicate that the earring 12 and clutch 14 have not been disassembled and broken gates 32 indicate that the earring and clutch have been disassembled at some point. When the tamper proof device 10 is utilized with a display card, the device is hidden behind the card along with the clutch 14, wherein it is operative for indicating if the earrings 12 have been disassembled from the earring card.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A tamper proof device for a pierced earring assembly that includes a post portion and a clutch portion comprising:

an outer frame portion including means for engaging said clutch portion of said pierced earring assembly;

an inner body portion including means for engaging said post portion of said pierced earring assembly; and a plurality of break-away gates which integrally join said outer frame portion and said inner body portion, said break-away gates breaking and thereby separating said inner body portion from said outer frame portion when said post portion is pulled apart from said clutch portion.

2. A tamper proof device for a pierced earring comprising:

an outer ring portion including means for engaging a clutch portion of said pierced earring;

an inner disc portion including means for frictionally engaging a post portion of said pierced earring; and a plurality of break-away gates which integrally join said disc portion and said ring portion, said clutch portion being receivable within said ring portion, said earring post being frictionally engageable With said disc portion and being receivable into said clutch portion, said break-away gates breaking and thereby separating said disc portion from said ring portion when said earring post is pulled apart from said clutch portion.

3. In the tamper proof device of claim 2, said outer ring portion having upper and lower peripheral edges and a plurality of protuberances extending radially inwardly from the lower peripheral edge for engaging said clutch portion.

4. In the tamper proof device of claim 3, said inner disc portion having an outer peripheral edge, said means for frictionally engaging said post portion comprising a central aperture.

5. In the tamper proof device of claim 4, said break-away gates extending radially outwardly from the peripheral edge of the disc portion and merging with the upper peripheral edge of the ring portion.

6. In the tamper proof device of claim 4, said central aperture having a taper which decreases in diameter from an upper surface thereof to a lower surface thereof.

7. In the tamper proof device of claim 2, wherein said ring portion, said disc portion and said break-away gates are integrally formed from plastic.

8. A tamper proof device for a pierced earring assembly that includes a post and a clutch comprising:

an outer ring portion having upper and lower peripheral edges and a plurality of protuberances extending radially inwardly from the lower peripheral edge;

inner disc portion having an outer peripheral edge and a central aperture which is operative for frictionally engaging the post of said pierced earring assembly; and a plurality of break-away gates which extend radially outwardly from the peripheral edge of the disc portion and merge with the upper peripheral edge of the ring portion, said clutch being positionable within said ring so as to rest between said disc portion and said protuberances, said post being slidably and frictionally receivable through said central aperture in said disc portion and into said clutch, said aperture in said disc portion frictionally engaging said post so that said break-away gates break thereby separating said disc portion from said ring portion when said post is pulled apart from said clutch.

9. In the tamper proof device of claim 8, said central aperture having a taper which decreases in diameter from an upper surface thereof to a lower surface thereof.

10. In the tamper proof device of claim 8 wherein said ring portion, said disc portion and said finger portions are integrally molded from plastic.

* * * * *